US005320081A

United States Patent [19]

Rice

[11] Patent Number: 5,320,081

[45] Date of Patent: Jun. 14, 1994

[54] FUEL INJECTION ECONOMIZER

[76] Inventor: Harold L. Rice, P.O. Box 228, Wrightsville, Ga. 31096

[21] Appl. No.: 155,778

[22] Filed: Nov. 23, 1993

[51] Int. Cl.[5] ..... F02D 41/14

[52] U.S. Cl. ..... 123/698; 123/445; 123/452

[58] Field of Search ..... 123/445, 452, 457, 514, 123/698

[56] References Cited

U.S. PATENT DOCUMENTS

| | | | |
|---|---|---|---|
| 3,890,946 | 6/1975 | Wahl | 123/684 |
| 3,960,118 | 6/1976 | Konomi et al. | 123/698 |
| 4,088,100 | 5/1978 | Tokura et al. | 123/683 |
| 4,169,441 | 10/1979 | Hirano et al. | 123/698 |

FOREIGN PATENT DOCUMENTS

| | | | |
|---|---|---|---|
| 2-153241 | 6/1990 | Japan | 123/698 |

*Primary Examiner*—Tony M. Argenbright
*Attorney, Agent, or Firm*—Richard C. Litman

[57] ABSTRACT

To improve combustion efficiency of gasoline engines having fuel injection responsive to, among other inputs, an exhaust sensor, fuel is introduced into the intake manifold in a constant stream. The fuel is taken from a return line returning excess fuel from the fuel injection system back to the fuel tank. This fuel is fed into a vacuum conduit in communication with the intake manifold, the vacuum conduit preferably being a fuel cannister purge line, or a positive crankcase ventilation line. Fuel vaporizes due to being subjected to high vacuum over a long path of travel. As the proportion of fuel introduced into the engine as a vapor increases, and reliance upon fuel which is merely atomized by the fuel injection system decreases, combustion efficiency is improved.

3 Claims, 2 Drawing Sheets

FUEL INJECTION ECONOMIZER

BACKGROUND OF THE INVENTION

1. Field of the Invention

The present invention relates to improving efficiency of gasoline engines, and more particularly to supplementary introduction of fuel into the intake manifold at a point other than by co-existing fuel injection valves.

2. Description of the Prior Art

Careful control over the quantity of fuel fed to gasoline engines has been the subject of great attention in the prior art. The purpose of such control includes economy of fuel consumption; compliance with pollution emission limits; power and response of an engine; and increased longevity of an engine, as by reducing carbon deposits therein.

It has been the experience of the automotive industry that some of these purposes, and in particular, the first two mentioned above, frequently work at cross purposes. Precise fuel control, as provided by electronically controlled fuel injection systems seem to offer the best hope for addressing all these concerns satisfactorily. Therefore, refinement to fuel control may be expected to be reflected in fuel injection systems. Patents disclosing incorporation of one significant refinement relevant to the present invention are discussed below.

U.S. Pat. Nos. 3,890,946, issued to Josef Wahl on Jun.24, 1975, and 3,960,118, issued to Toshiaki Konomi et al. on Jun.1, 1976, each show an engine fuel arrangement wherein a carburetor is purposefully designed to provide a lean mixture. A supplementary fuel injection valve is provided to make necessary adjustments to the fuel-to-air ratio. An exhaust sensor monitoring exhaust gases for oxygen content provide the input to a microprocessor or equivalent device, which in turn sends a control signal to the fuel injection valve. The fuel injection valve provides a compensating and complementary quantity of fuel to the engine responsive to the control signal.

Still further examples generally illustrating the approach described above are seen in U.S. Pat. Nos. 4,088,100, issued to Naomi Tokura et al. on May 9, 1978, and 4,169,441, issued to Tadayoshi Hirano et al. on Oct. 2, 1979.

Japanese Pat. Application No. 63-307639, dated Jun. 12, 1990, provides two fuel injection valves to accomplish the same result. One of these injection valves is responsive to a signal derived from an exhaust sensor.

None of the above inventions and patents, taken either singly or in combination, is seen to describe the instant invention as claimed.

SUMMARY OF THE INVENTION

In today's competitive world, it is desired to attain the purposes of fuel control listed above, and to produce a power plant at minimal economic cost. While fuel injection systems in production today generally accomplish the aforementioned purposes, there nonetheless remains room for improvement. The applicant's experience is that engine performance, particularly reflected in terms of fuel economy, may be enhanced by the present invention.

According to the present invention, fuel is obtained from the fuel supply system in liquid form, and is introduced into a portion of the vacuum system of the engine, eventually being drawn into the cylinders through the intake manifold.

This technique is particularly suited to postproduction modification to automobiles due to, firstly, its uncomplicated structure and secondly, its cooperation with pre-existent engine components.

Fuel is taken from a return line which returns excess fuel rejected by the fuel injection to the fuel tank. This fuel is placed in communication with a vacuum source through a conduit which includes a restricting orifice. The restricting orifice assures that the amount of fuel introduced thereby will never exceed the minimal fuel requirements of the engine. The otherwise conventional fuel injection system compensates for requirements for fuel which are above the fuel delivered through the novel conduit and orifice.

There are no moving parts or complicated structure associated with this apparatus. Connection of this conduit to the intake manifold is made at a pre-existing positive crankcase ventilation line or a fuel cannister purge line. Both aforementioned lines are conduits which are ultimately in communication with the intake manifold.

A critical difference between this approach and prior art approaches is that in the prior art, supplementary fuel is either injected under pressure into an airstream, or is drawn in at a point of maximal restriction. In either case, the fuel is atomized into droplets which are then conducted into the cylinders for combustion. In the present invention, fuel must follow a long and complicated path from its introduction to the engine, and the cylinders. It is possible that the effectiveness of the present invention is due to introduction of supplementary fuel in vapor form, rather than in the form of droplets.

In vapor form, fuel may better mix with air, and be burned more completely than droplets. Droplets may experience partial combustion, the core of the droplet remaining unburned. Also, a given mass of fuel, when in the vapor state, will present greater surface area to air, thus speeding progression of a flame front through the air-fuel mixture.

An exhaust sensor, typically monitoring oxgyen content of the exhaust gases, may determine residual oxygen, but is unable to discriminate among other exhaust components. Therefore, when parameters relating to oxygen are satisfied, the fuel injection system microprocessor will make no adjustments, even when significant quantities of unburned or partially burned fuel are present.

Therefore, the present invention leans air-fuel mixtures while enabling surplus oxygen to be present in the exhaust. The surplus oxygen condition then causes the fuel injection system to avoid compensation to occur, which compensation is achieved by enriching the mixture. Such enrichment is inappropriate and uneconomical.

It should be understood that the primary application of the present invention is to gasoline fueled automobile engines, but that any liquid fueled, internal combustion engine having fuel injection or the equivalent including and responsive to an exhaust sensor is encompassed thereby. In this spirit, fuel will be referred to as gasoline, recognizing that the principles embodied herein apply to any oxidized liquid fuel. Similarly, the term "fuel injection" will refer to any fuel metering system responsive to conditions including engine conditions, as well as to operator demand. Also, it is recognized that an intake manifold may comprise individual runners not in mutual communication, and that in such instances, connection is made to any one or more runners upstream of the intake valve, and below any throttle or other restricting device present, if any. In this vein, the term "intake manifold" may refer to conduits formed in a cylinder head, or still other conduits subject to pressure drop from the intake stroke of pistons. Likewise, the fuel injection system may include a single or plural injection valves.

Accordingly, it is a principal object of the invention to provide a leaner mixture to an engine for combustion, while causing the proportion of residual oxygen present in exhaust to remain constant.

It is another object of the invention to introduce supplementary fuel into the intake manifold of a gasoline engine downstream of any restriction to airflow.

It is a further object of the invention to introduce supplementary fuel into an engine by uncomplicated and inexpensive apparatus.

Still another object of the invention is to introduce supplementary fuel into an engine which is restricted to a minimal value equal to or less than the minimal running requirement of the engine under all conditions.

An additional object of the invention is to introduce supplementary fuel into an engine at a pre-existing conduit thereof, which pre-existing conduit is in communication with manifold vacuum.

It is again an object of the invention to obtain supplementary fuel from an unused source of liquid fuel which source is located proximate the engine.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
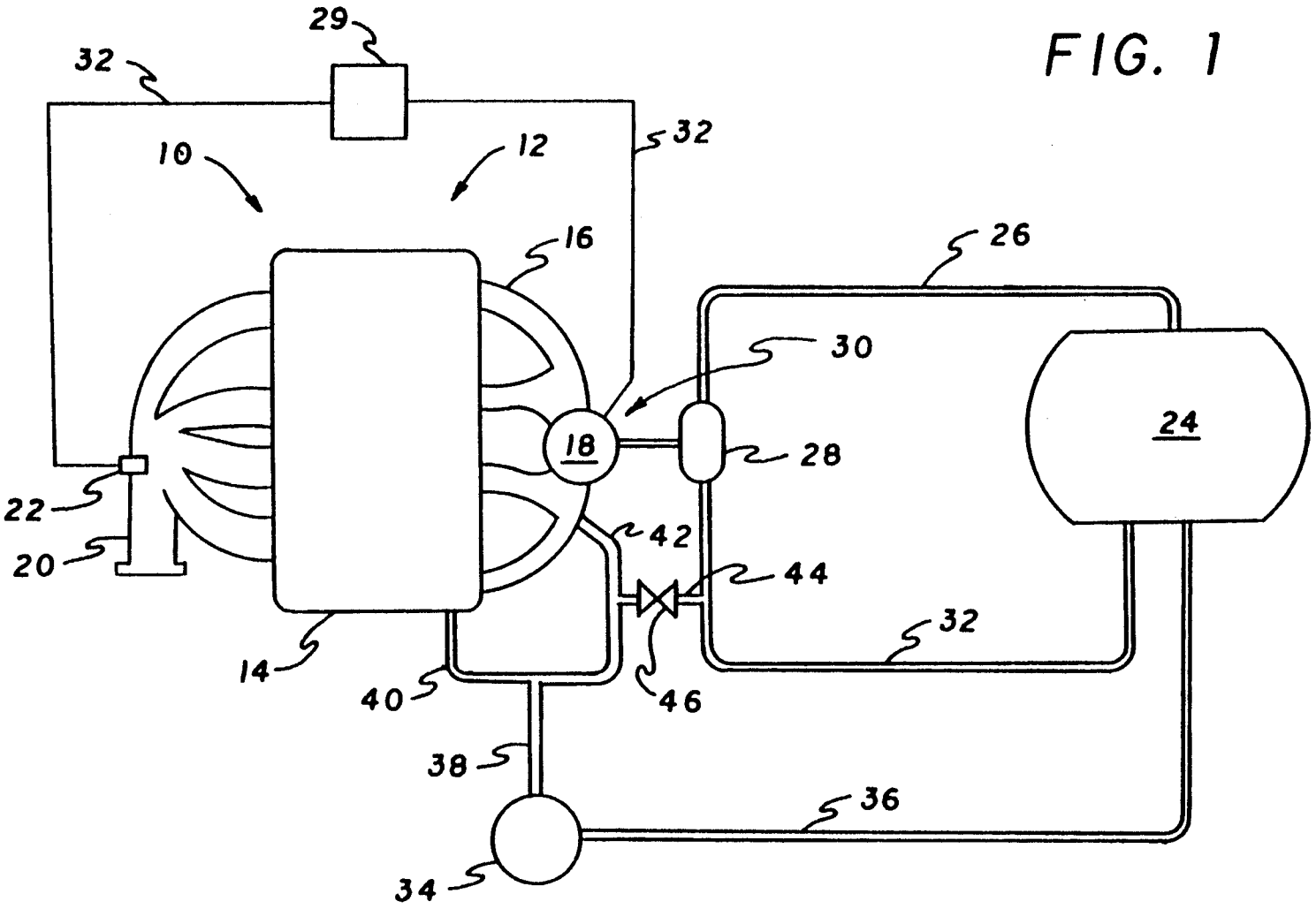
FIG. 1 is a diagrammatic representation of an engine and associated fuel system, including the present invention.

With reference to FIG. 1, a typical fuel injected engine 10 is shown, including at least one combustion cylinder 12 located in an engine block 14; an intake manifold 16 communicating with a throttle body 18 or other housing enclosing a chamber wherein fuel is injected into an air stream; and an exhaust manifold 20 supporting an exhaust sensor 22 in communication with the exhaust stream.

The fuel system includes a fuel supply tank 24; a supply conduit or line 26 bringing fuel to a fuel pump 28; a microprocessor 29 accepting an input from sensor 22 and sending a control signal to a fuel injection valve through communication conductors 31; at least one fuel injection valve 30 delivering a metered quantity of fuel into intake manifold 16; and a return conduit or line 32 returning surplus fuel pumped to fuel injection valve 30 back to tank 24.

Automobiles are typically equipped with pollution control apparatus including a charcoal cannister 34 for trapping hydrocarbon fumes which would otherwise pollute ambient air, and a positive crankcase ventilation (PCV) system for trapping hydrocarbon laden crankcase fumes. A cannister conduit or line 36 communicates between cannister 34 and fuel tank 24. Cannister 34 is typically purged by intake manifold vacuum, there being a cannister purge conduit or line 38 leading from cannister 34 to vacuum present in intake manifold 16. The PCV system conducts its respective fumes back into a cylinder 12 by a PCV conduit or line 40 which also communicates with intake manifold vacuum. A common connecting conduit 42 originating at intake manifold 16 is generally furnished to enable both cannister and PCV scavenging.

A conduit 44 is connected to fuel return line 32, conducting fuel to any convenient point of conduit 38, 40, or 42. The term "return line" is understood to encompass any portion of fuel supply or return conduits 26,32 and associated components holding or conducting fuel which is not constrained to pass through fuel injection valve 30 as a consequence of subsequent engine operation. Illustratively, this could include both fuel actively being returned to tank 24, or fuel which merely occupies voids formed within conduits, housings, fittings, and the like, remaining stagnant therein, serving to enable other fluid to be supplied to combustion cylinders 12 or to be actively returned to tank 24.

Conduit 44 includes a restrictor 46, which may be as uncomplicated as a solid plug having a bore of predetermined diameter, or cross sectional area. The predetermined diameter is calculated to limit fuel flow to a rate equal to or less than a minimum fuel flow required to sustain engine 10 under the least fuel demanding conditions. Conduit 44 is of static internal geometry, with or without restrictor 46, in the sense that cross sectional area determining flow rate of fuel therethrough does not change, as would a fuel injection valve. In a fuel injection valve, a pintle obstructs the fuel orifice in response to signals to open and close. Cross sectional area of the fuel orifice varies, therefore, between a maximum value with the pintle in the fully open position, and zero, when the pintle is in the closed position.

Conduit 44 must be sufficiently shielded from heat so that neither it nor restrictor 46 swells and is restricted thereby.

Conduit 44 terminates at a point of maximal vacuum, or pressure drop, within intake manifold 16 This point is located upstream of an intake valve, and downstream of obstructions, such as a throttle, mass flow sensor, a venturi (none shown), or other apparatus projecting into any portion of intake manifold 16 or of any conduit conducting a fuel-air mixture to a cylinder 12.

Figure 2:
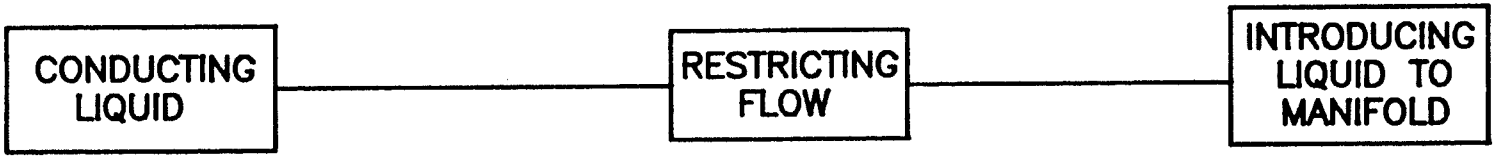
FIG. 2 shows the steps, in diagrammatic block form, of a method of practicing the present invention.

Critical parameters of the invention may be further clarified when stated as a method, steps of this method being summarized in FIG. 2, reading left to right. First, fuel is drawn from a suitable source, such as return line 32, in liquid form. Next, this fuel is restricted to flow at the minimal flow rate discussed hereinbefore. Then, restricted fuel is introduced to intake manifold 16 at a point upstream of inlet valves (not shown) and downstream of all restrictions to the cross sectional area of intake manifold 16.

It is to be understood that the present invention is not limited to the sole embodiment described above, but encompasses any and all embodiments within the scope of the following claims.

I claim:

1. An air and fuel mixing system for fueling a liquid fueled, internal combustion engine having at least one combustion cylinder, an intake manifold conducting air and fuel to the at least one combustion cylinder; a fuel supply system including a fuel tank, a fuel pump, fuel supply and return lines; and a fuel system and pollution control equipment including a conduit returning polluting fumes to the intake manifold, said air and fuel mixing system including:

a fuel injection system comprising a fuel injection valve, a microprocessor accepting inputs and generating a signal controlling the fuel injection valve, an exhaust sensor supplying an input to the microprocessor; and a supplementary fuel conduit connected between and in fluid communication with the fuel system return line and the intake manifold, said supplementary fuel conduit being of static internal geometry, and conducting fuel from the fuel system return line to a point of maximal pressure drop within the intake manifold.

2. The air and fuel mixing system according to claim 1, said supplementary fuel conduit further comprising a restrictor therein having means defining an orifice of predetermined cross sectional area, whereby maximum flow of fuel through said supplementary fuel conduit is limited to a rate below the capacity of said supplementary fuel conduit existing in the absence of said restrictor.

3. A method of producing a fuel and air mixture for fueling an internal combustion engine, comprising the steps of:

(a) conducting liquid fuel from a return line;

(b) restricting rate of flow of the liquid fuel of step (a) to that limited to satisfying a minimum fuel demand rate of the engine; and (c) introducing the restricted liquid fuel to a point of maximum pressure drop within the intake manifold.

* * * * *